United States Patent [19]

Odenthal

[11] Patent Number: 5,010,712

[45] Date of Patent: Apr. 30, 1991

[54] METHOD OF AND APPARATUS FOR THE PACKAGING OF PRESSURE-SENSITIVE ARTICLES

[75] Inventor: Heinz F. Odenthal, Züpich, Fed. Rep. of Germany

[73] Assignee: Ostma Maschinenbau GmbH, Zulpich, Fed. Rep. of Germany

[21] Appl. No.: 565,019

[22] Filed: Aug. 8, 1990

[30] Foreign Application Priority Data

Aug. 9, 1989 [DE] Fed. Rep. of Germany ..... 3926261

[51] Int. Cl.[5] ..... B65B 5/04; B65B 23/00

[52] U.S. Cl. ..... 53/55; 53/207; 53/251; 53/462

[58] Field of Search ..... 53/462, 461, 467, 564, 53/207, 209, 55, 251, 250, 244, 259

[56] References Cited

U.S. PATENT DOCUMENTS 3,354,613 11/1967 Anderson et al. ..... 53/251
4,578,930 4/1986 Simelunas et al. ..... 53/251 X
4,694,632 9/1987 Gunther, Jr. ..... 53/55
4,809,575 3/1989 Swanson ..... 53/55 X
4,815,254 3/1989 Fischer ..... 53/462 X

FOREIGN PATENT DOCUMENTS 1258779 1/1968 Fed. Rep. of Germany .
356400 8/1961 Switzerland .
1444640 8/1976 United Kingdom .

*Primary Examiner*—James F. Coan
*Attorney, Agent, or Firm*—Herbert Dubno

[57] ABSTRACT

Baked goods, deep-frozen comestibles and like pressure-sensitive articles are packaged by passing the articles along a transport belt onto a delivery belt which can receive only one article at a time and then controlling the speed of this belt, to precisely deposit the article one at a time upon the packing underlay forming part of a prefolded box advanced past the delivery belt on a box conveyor.

6 Claims, 2 Drawing Sheets

METHOD OF AND APPARATUS FOR THE PACKAGING OF PRESSURE-SENSITIVE ARTICLES

FIELD OF THE INVENTION

My present invention relates to a method of and an apparatus for the packaging of pressure-sensitive articles and especially baked goods and deep-frozen foods.

BACKGROUND OF THE INVENTION

It is known in the packaging of baked goods, such as cakes, pies, tortes, tarts and pastry items and, generally, in the packaging of articles sensitive to pressure and which can be deformed by the application of pressure, to displace the articles to be packaged continuously in a forward direction and to cause them to deposit upon packaging underlays which can then be enclosed by a cover member.

Both the articles and the packaging underlays can be fed to a location at which they meet at a given point in time so that the transfer is effected from the article conveyor to the underlay with a minimum of disturbance to the article. Generally the two paths are inclined at an acute angle to one another converging that location.

In Swiss patent 356,400, baked goods are deposited on packing underlays which are fed beneath the transfer location with practically no spacing between them. The baked goods, fabricated in cavities of a forming roll and deposited upon a suction belt, are transported by this belt to the transfer location. It is essential for this system and, indeed, a key aspect of the fabrication method, that the baked articles always be at a fixed distance from one another along the transport belt. For a transfer of the baked articles to the packing underlays, in this system, therefore, all that is required is a synchronization of the drives for the transport conveyor and the underlay conveyor which generally is effected by mechanically coupling them.

For a large number of products, however, especially cakes and deep-frozen comestibles, the maintenance of a constant fixed distance between the articles on the transport conveyor cannot be assured. For such products, therefore, the method of the Swiss patent cannot be used.

German printed application DE-AS 12 58 779 describes a process in which the articles advanced on a transport belt are engaged by entrainers of a high-speed circulating conveyor and transferred thereby to a further belt which is connected with a packaging machine. With the aid of the circulating conveyor, the articles to be packed are positioned equidistantly upon the packaging-belt conveyor. At another location, the packaging process can be carried out. This two-stage approach to effectively positioning the articles along transport conveyors requires expensive equipment and, from a technological viewpoint, is expensive. With highly pressure-sensitive products, such as cakes, damage may be caused to the product by the entrainers circulating at higher speeds.

British patent 1,444,640 describes a process for packaging pressure-sensitive comestible products, including baked goods, utilizing an intermittently operating system. The articles to be packaged are moved transversely to the transport direction of the packaging materials and are shoved onto the packaging material when the packaging material comes to rest. The operating speed in such processes is capable of improvement.

OBJECTS OF THE INVENTION

It is the principal object of the present invention to provide a method of packaging pressure-sensitive articles, especially baked goods, deep-frozen comestible products, whereby the drawbacks of earlier systems are avoided.

Another object of the invention is to provide an improved apparatus for the packaging of such products in which the packaging can occur continuously at a freely selectable cadence and in a process which does not necessarily require absolute regularity in the timing of the meeting between the article and the packaging material.

Still another object of this invention is to provide a method of and an apparatus for the packaging of pressure-sensitive materials which can be economical, free from the drawbacks of the prior art and, in addition, provide for improved handling of the articles.

SUMMARY OF THE INVENTION

These objects and others which become apparent hereinafter are attained, in accordance with the invention, by a method of packaging pressure-sensitive articles, especially baked goods and deep-frozen comestibles, which comprises the steps of:

(a) advancing prefolded boxes each formed with a packing underlay in mutually spaced relationship continuously in succession in a transport direction along a transport path so that each of the packing underlays extends away from a respective cover and is formed with sidewall flaps;

(b) simultaneously advancing on a continuously driven transport belt above the boxes, a succession of the articles in mutually spaced relationship in the direction;

(c) transferring the articles one at a time from the transport belt to a delivery belt converging toward the path so that only one of the articles at a time is present on the delivery belt (d) continuously feeding each of the articles on the delivery belt to a transfer location substantially meeting a respective one of the packing underlays to transfer the article to the respective underlay;

(e) controlling a speed of the delivery belt for each article thereon so that each article meets the respective underlay at the location; and (f) erecting the respective flaps of each underlay to which a respective article has been transferred and folding the respective cover thereover to enclose the article in the respective box.

The apparatus for this purpose can comprise:

a continuous packaging conveyor for advancing foldable boxes each formed with a packing underlay in mutually spaced relationship continuously in succession in a transport direction along a transport path;

a transport belt for simultaneously advancing above the boxes, a succession of articles in mutually spaced relationship in the direction;

a delivery belt juxtaposed with the transport belt above the conveyor and having a delivery apron inclined at an acute angle to the conveyor for receiving the articles one at a time from the transport belt and dimensioned such that only one of the articles at a time is present on the delivery belt, the delivery belt carrying each article thereon to a transfer location at which the apron is at most several millimeters above a respective underlay so that each of the articles substantially meets a respective one of the packing underlays to transfer the article to the respective underlay;

a variable-speed drive connected to the delivery belt for driving same at a regulatable speed; and control means responsive to positions of the boxes on the conveyor and of the articles and connected to the variable-speed drive for controlling a speed of the delivery belt for each article thereon and a timing of arrival of each article at the location so that each article meets the respective underlay at the location.

Naturally, when reference is made to a single article on the delivery conveyor or belt herein, that article will be understood to consist of a single piece or any number of pieces intended to be incorporated together in the single package.

According to the invention, therefore, the article to be packaged is deposited upon the packing underlay of a folded box, the continuously supplied articles are transferred one at a time to the delivery belt so that only one article, as defined above, is present on the delivery belt at any time and is carried by the delivery belt to the delivery apron at which the article is shoved onto the packing underlay, the spacing between the articles on the transport belt and the folded boxes on the conveyor are monitored, and the speed of the delivery belt is so controlled that the articles will meet the respective folded box at the proper point in time for transfer of the article to the folded box while the folded box continues to move along the convey. Finally, the sidewalls formed on the packing underlay are erected and a cover applied thereto.

Preferably the articles are displaced along the transport belt with a distance generally corresponding to the spacing of the folded boxes on the conveyor. In that case, articles to be packed can be moved with a conveyor speed corresponding to the set-point speed of the boxes to the transfer location and only a small speed difference is made up by the variation and speed of the delivery belt to ensure that each article will probably meet the continuously-moving packing underlay.

When one provides upstream of the delivery belt, a transport belt for the articles to be packaged whose speed also can be controlled in accordance with the spacing of the articles and the spacing of the boxes and the rates at which these are to be delivered to the transfer location, a further minimization of the speed differential which must be made up by the delivery belt at the transfer location between the articles and the packing underlays, is possible.

With the method of the invention, therefore, it is possible to package pressure-sensitive food items, especially baked goods, which are only engaged from below so that there is no distortion or damage to the article. The process is fully continuous and can operate at high speed.

The process is especially efficient when, by controlling the feed rate of the articles upstream of the delivery belt and by maintaining a spacing of the articles thereon corresponding to the box spacing, only very small differentials between the packing underlays and the articles to be deposited thereon need be considered. Slipping of the articles on or relative to the packing underlays is excluded and a high-speed but precise positioning of the articles on the packing underlay is possible. The method has been found to be particularly effective for the packaging of fancy cakes and deep-frozen comestible articles.

In a preferred embodiment of the apparatus of the invention, the folded-box conveyor has, in the region of the transfer location, an upwardly-inclined transport segment connected to a horizontal transport segment below this location so that the folded boxes are displaceable at a vertical distance below the articles to be packaged and displaced along the transport and delivery belts, the conveyor carrying the folded box underlay upwardly past the transfer location and carrying off the packing box underlays with the articles deposited thereon above the transfer location.

With this construction, the transport device for the articles to be packaged can remain substantially horizontal.

It is of course important, indeed vital, that the transfer at the transfer location be as step-free as possible. This can be realized by forming the delivery belt with upper and lower belt stretches which converge toward the delivery apron and form an acute angle at the delivery apron which likewise can converge at an acute angle toward the box conveyor.

It has been found to be advantageous, in carrying out the method of the invention, to fold the box as much as possible before it receives the article. For example, the packing underlay can extend from a fully folded cover part. The cover part can have the top of the box and, extending at right angles thereto, the preformed sidewalls. When the side flaps of the packing underlay, forming the bottom of the box, are then erected, the box can be closed.

With a prefolded box of this type, the packing underlay can extend at a level different from the level at which the cover is supported. According to the invention, therefore, the box conveyor can comprise two supporting surfaces separated by a step which can form an abutment for the prefolded cover and the packing underlay can be supported on the higher surface while the cover is supported on the lower surface.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
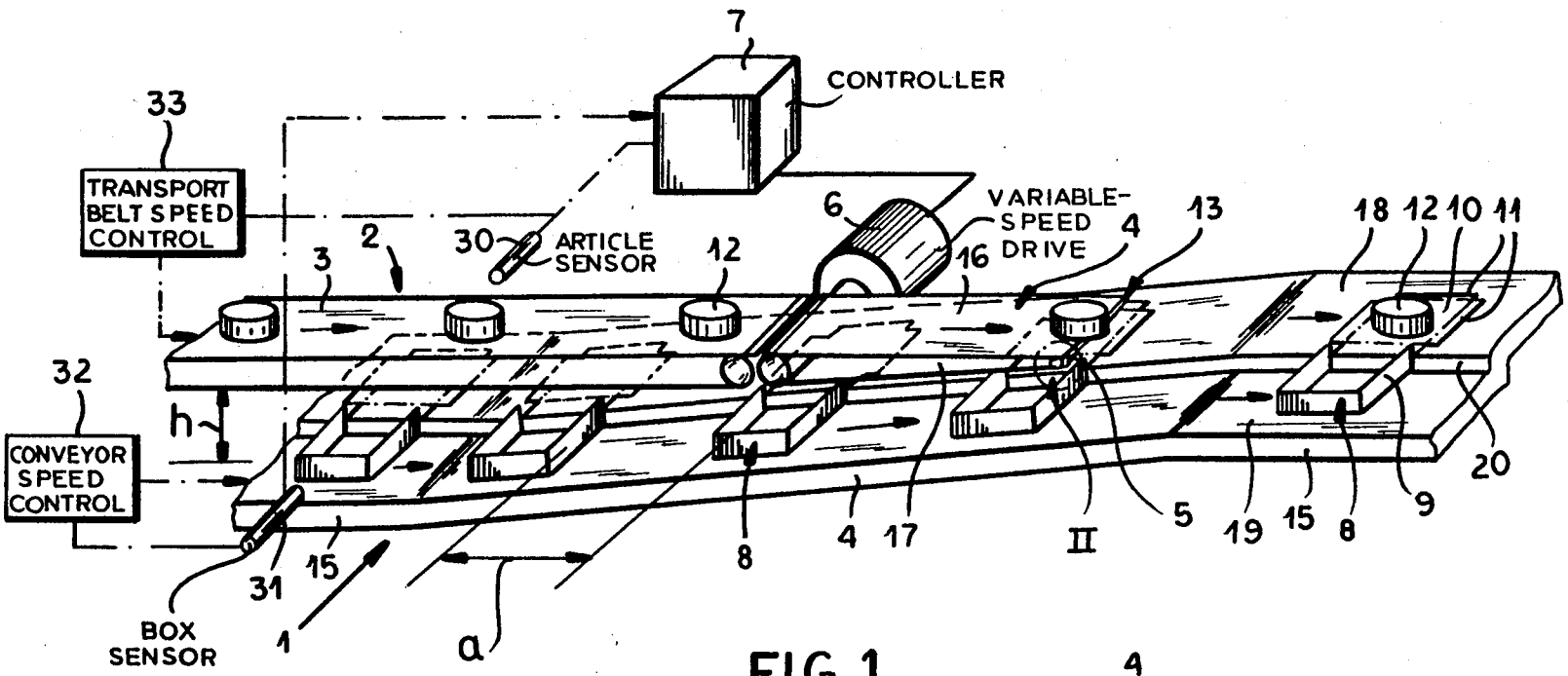
FIG. 1 is a diagrammatic perspective view of an apparatus for carrying out the packaging method of the invention.
Figure 2:
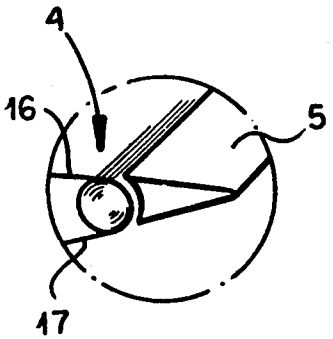
FIG. 2 is a detail view of the region II of FIG. 1.

The apparatus shown in FIGS. 1 and 2 is employed for the packing of cakes in boxes.

The apparatus comprises a continuous folded-box conveyor 1, and a transport unit 2 for the articles 12 to be packaged, namely, the cakes.

The transport unit 2 comprises a transport belt 3 and a delivery belt 4 with a delivery apron 5 converging toward the packing underlay 10 onto which the cake is to be deposited at a transfer location represented at 13.

The delivery belt 4 comprises a drive unit 6 of controllable speed. That drive unit may be a variable-speed motor connected to a respective roller of the delivery belt 4, and provided, in turn, with a control unit connected to this motor and shown in a box configuration.

An article sensor 30 can be connected to the controller 7 and a box sensor 31 can likewise be connected to the controller 7 to regulate the speed of the delivery belt 4 in the manner described below. The apparatus can also include a conveyor speed control 32 receiving an input from the box sensor to maintain a set-point speed of the box conveyor and a transport belt speed control 33 which can be connected to the article sensor 30 to maintain generally speed of the transport belt corresponding to the speed of the box conveyor.

From FIGS. 1 and 2, it will be apparent that prefolded boxes 8 are continuously advanced in a forward direction on the box conveyor 1. The folded boxes 8 have a prefolded cover 9 in addition to the packing underlay 10 which ultimately will form the bottom of the box. The packing underlay 10 is formed with sidewall flaps 11.

The articles 12 to be packed are fed by the transport belt 3 in the same transport direction above the conveyor 1 and the boxes 8 thereon to the delivery belt 4 and onto the latter.

The delivery belt 4 is dimensioned so that only one article 12 can be transported thereby at any time and the delivery belt feeds this article at an acute angle to the transfer location 13 onto the packing underlay 10 as the latter is continuously moved there past The controlling unit 7 monitors the spacing of the article 12 and the box 8 form the transfer location 13 and so regulates the speed of the delivery belt 4 that the article 12 is deposited with precision on the respective box 8.

The articles 12 are preferably spaced apart by a distance a corresponding to the spacing of the boxes and are transferred to the delivery belt with this spacing.

As shown, the transport belt 3 is provided with the controllable drive 33 to allow the speed of the transport belt 3 to be controlled so that the article 12 position on the delivery belt and the respective folded box 8 are already so positioned that they can move with approximately the same speed to meet at the transfer location 13 without adjustment of the speed of the belt 4.

The controllable drive 6 for the delivery belt 4 thus serves only to compensate for minor position deviations. It will be understood that the position data of the articles 12 deposited upon the delivery belt 4 is used as a control input for the speed of the delivery belt. This position data can also be used as shown for controlling the speed of the upstream transport belt 3. More advantageous, however, is a system whereby the control of the transport belt 3 upstream of the delivery belt is controlled by an average value from a number of position data inputs.

The transport belt 3 and the delivery belt 4 are arranged in the transport direction above the box conveyor 1 so that the transfer belt 4 and the folded-box conveyor approach one another at an acute angle.

As can be seen from FIG. 1, the box conveyor 1 can have a rising transport segment 14 connected to a horizontal transport segment 15. The folded boxes 8 can thus be fed in the forward direction with a vertical distance h below the articles 12 and then rise to the transport location to be carried off above the transport location 13.

At the transport location 13, the packing underlays 10 of the folded boxes 8 are passed with a distance of only several millimeters below the delivery apron 5 of the delivery belt 4.

The delivery apron 5 is shorter than the objects 12 to be packaged. It is also possible to see from the drawing that the delivery belt 4 and its delivery apron 5 can be convergent in the delivery direction and that the belt can have convergent upper and lower stretches 16 and 17, respectively. The apron 5 can have a similar taper.

The box conveyor 1 has two support surfaces 18 and 19 separated by a longitudinally-extending step 20. The upper support surface 18 receives the packing underlay or box bottom 10 with its sidewall flaps preformed but unfolded thereon. The lower support surface 19 receives the prefolded cover 9 with its sidewalls. One of these sidewalls is connected to one of the sidewalls 11 of the packing underlay. The prefolded cover 9 can rest against the step 20 so that the latter forms a stop for precisely positioning the box.

Figure 3:
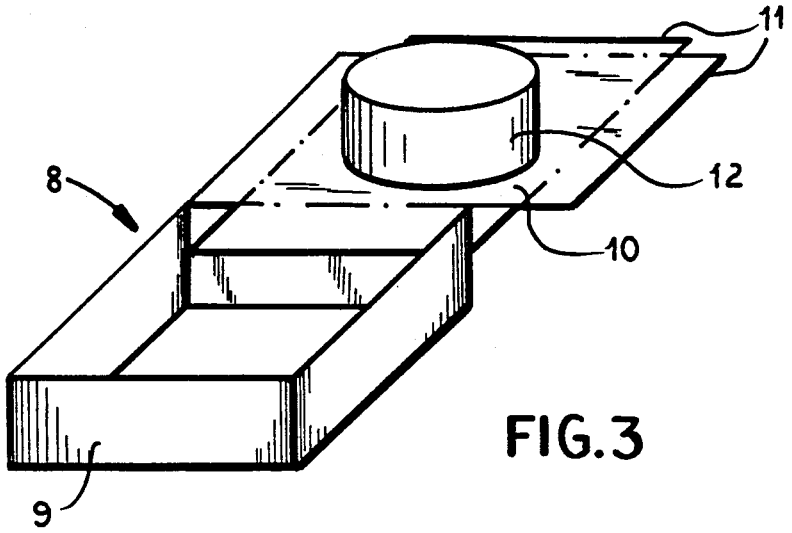
FIGS. 3-5 show diagrammatically successive steps in the process of the invention.
Figure 4:
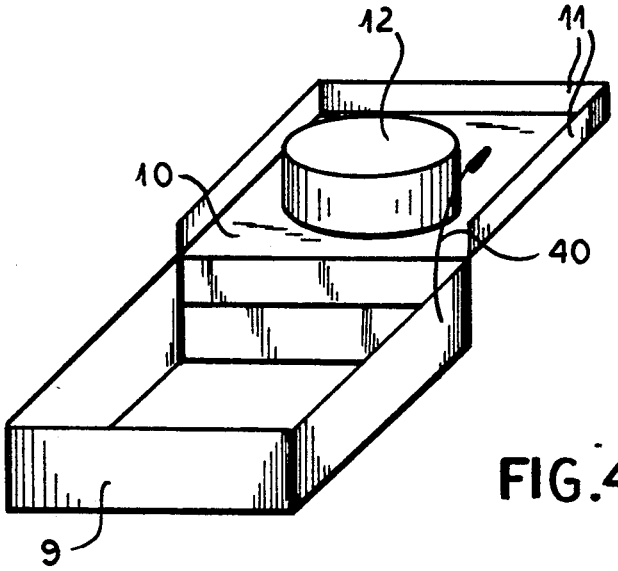
Figure 5:
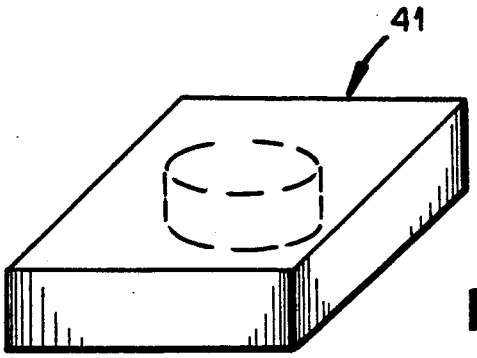

As can be seen from FIG. 3, the article 12 is positioned accurately on the packing underlay 10 while the flaps 11 remain unerected. Downstream of the region shown in FIGS. 1 and 2, the sidewall flaps are erected (FIG. 4) and the cover 9 swung upwardly as represented by the arrow 40 to close the box and complete the package 41 as shown in FIG. 5.

While the apron 5 is shown to be adjacent the belt 4 in FIG. 2, it is also possible to pass the belt 4 around the apron, in which case the upper and lower stretches 16 and 17 of the belt will meet at the edge of the apron.

I claim:

1. A method of packing pressure-sensitive articles, comprising the steps of:

(a) advancing prefolded boxes each formed with a packing underlay in mutually spaced relationship continuously in succession in a transport direction along a transport path so that each of said packing underlays extends away from a respective cover and is formed with sidewall flaps;

(b) simultaneously advancing on a continuously driven transport belt above said boxes, a succession of said articles in mutually spaced relationship in said direction;

(c) transferring said articles one at a time from said transport belt to a delivery belt converging toward said path so that only one of said articles at a time is present on said delivery belt;

(d) continuously feeding each of said articles on said delivery belt to a transfer location substantially meeting a respective one of said packing underlays to transfer the article to the respective underlay;

(e) controlling a speed of said delivery belt for each article thereon so that each article meets the respective underlay at said location; and (f) erecting the respective flaps of each underlay to which a respective article has been transferred and folding the respective cover thereover to enclose the article in the respective box.

2. The method defined in claim 1 wherein said articles are transferred to said delivery belt from said transport belt with approximately the same spacing as the spacing between the boxes along said path.

3. A method of packaging baked goods and deep-frozen goods, comprising the steps of:

(a) advancing prefolded boxes formed with a packing underlay in mutually spaced relationship continuously in succession in a transport direction along a transport path so that said packing underlay extends away from a respective cover and is formed with sidewall flaps;

(b) simultaneously advancing on a continuously driven transport belt above said boxes, a succession of articles constituted of baked goods or deep-frozen goods in mutually spaced relationship in said direction;

(c) transferring said articles one at a time from said transport belt to a delivery belt converging toward said path so that only one of said articles at a time is present on said delivery belt;

(d) continuously feeding each of said articles on said delivery belt to a transfer location substantially meeting a respective one of said packing underlays to transfer the article to the respective underlay;

(e) controlling a speed of said delivery belt for each article thereon so that each article meets the respective underlay at said location; and (f) erecting the respective flaps of each underlay to which a respective article has been transferred and folding the respective cover thereover to enclose the article in the respective box.

4. A apparatus for packing pressure-sensitive articles, comprising:

a continuous packaging conveyor for advancing foldable boxes each formed with a packing underlay in mutually spaced relationship continuously in succession in a transport direction along a transport path;

a transport belt for simultaneously advancing above said boxes, a succession of articles in mutually spaced relationship in said direction;

a delivery belt juxtaposed with said transport belt above said conveyor and having a delivery apron inclined at an acute angle to said conveyor for receiving said articles one at a time from said transport belt and dimensioned such that only one of said articles at a time is present on said delivery belt, said delivery belt carrying each article thereon to a transfer location at which said apron is at most several millimeters above a respective underlay so that each of said articles substantially meets a respective one of said packing underlays to transfer the article to the respective underlay;

a variable-speed drive connected to said delivery belt for driving same at a regulatable speed; and control means responsive to positions of said boxes on said conveyor and of said articles and connected to said variable-speed drive for controlling a speed of said delivery belt for each article thereon and a timing of arrival of each article at said location so that each article meets the respective underlay at said location.

5. The apparatus defined in claim 4 wherein said conveyor has a horizontal stretch and, connected therewith, an upwardly inclined stretch carrying said boxes to said location and transporting said boxes with said articles on the respective underlays upwardly away from said location.

6. The apparatus defined in claim 4 wherein each of said packing underlays extends away from a respective prefolded cover and is formed with sidewall flaps, said conveyor having two mutually parallel support surfaces receiving said covers and said underlays respectively, said surfaces being separated by a longitudinally extending step so that an upper one of said surfaces is disposed above a lower one of said surfaces, said covers resting upon said lower one of said surfaces and said underlays resting upon said upper one of said surfaces, said step forming an abutment for said prefolded covers.

* * * * *